US010744616B2

(12) United States Patent
Kawasaki et al.

(10) Patent No.: US 10,744,616 B2
(45) Date of Patent: Aug. 18, 2020

(54) WAFER POLISHING METHOD AND APPARATUS

(71) Applicant: SUMCO CORPORATION, Tokyo (JP)

(72) Inventors: Tomonori Kawasaki, Tokyo (JP); Ryoya Terakawa, Tokyo (JP)

(73) Assignee: SUMCO CORPORATION, Tokyo (JP)

( * ) Notice: Subject to any disclaimer, the term of this patent is extended or adjusted under 35 U.S.C. 154(b) by 329 days.

(21) Appl. No.: 16/062,433

(22) PCT Filed: Nov. 4, 2016

(86) PCT No.: PCT/JP2016/082765
§ 371 (c)(1),
(2) Date: Jun. 14, 2018

(87) PCT Pub. No.: WO2017/104285
PCT Pub. Date: Jun. 22, 2017

(65) Prior Publication Data

US 2018/0369985 A1 Dec. 27, 2018

(30) Foreign Application Priority Data

Dec. 18, 2015 (JP) ..... 2015-247341

(51) Int. Cl.
*B24B 49/14* (2006.01)
*B24B 49/16* (2006.01)
(Continued)

(52) U.S. Cl.
CPC ..... *B24B 37/107* (2013.01); *B24B 37/005* (2013.01); *B24B 37/015* (2013.01);
(Continued)

(58) Field of Classification Search
CPC ... B24B 37/005; B24B 37/015; B24B 37/042; B24B 37/10; B24B 37/107; B24B 49/14; B24B 49/16
(Continued)

(56) References Cited

U.S. PATENT DOCUMENTS 4,450,652 A * 5/1984 Walsh ..... B24B 49/14 451/288
6,191,037 B1 * 2/2001 Robinson ..... B24B 37/013 257/E21.122
(Continued)

FOREIGN PATENT DOCUMENTS

JP 07-171759 A 7/1995
JP 07-307317 A 11/1995
(Continued)

OTHER PUBLICATIONS

International Search Report in International Patent Application No. PCT/JP2016/082765, dated Nov. 29, 2016.

*Primary Examiner* — Eileen P Morgan
(74) *Attorney, Agent, or Firm* — Greenblum & Bernstein, P.L.C.

(57) ABSTRACT

A wafer polishing method of polishing one surface of a wafer by rotating a rotating platen to which a polishing pad is affixed and a pressurizing head while supplying slurry onto the rotating platen and pressurizing/holding the wafer on the polishing pad with the pressurizing head, the method including: calculating an F/T value by monitoring a load current value F of a motor for rotating the rotating platen and a surface temperature T of the polishing pad during the wafer polishing; and controlling at least one of the rotation speed of the rotating platen and the polishing pressure of the pressurizing head based on the calculated F/T value.

10 Claims, 7 Drawing Sheets

(51) Int. Cl.

| | |
|---|---|
| ***B24B 37/10*** | (2012.01) |
| ***B24B 37/005*** | (2012.01) |
| ***B24B 37/015*** | (2012.01) |
| ***B24B 37/04*** | (2012.01) |
| ***B24B 37/20*** | (2012.01) |

(52) U.S. Cl.
CPC ..... *B24B 37/042* (2013.01); *B24B 37/10* (2013.01); *B24B 37/20* (2013.01); *B24B 49/14* (2013.01); *B24B 49/16* (2013.01)

(58) Field of Classification Search
USPC ..... 451/5, 7, 10, 11, 41, 53, 285, 287
See application file for complete search history.

(56) References Cited

U.S. PATENT DOCUMENTS

| | | | | |
|---|---|---|---|---|
| 6,568,989 | B1 * | 5/2003 | Molnar | B24B 37/013 451/41 |
| 6,976,902 | B2 * | 12/2005 | Koo | B24B 37/013 156/345.16 |
| 10,139,802 | B2 * | 11/2018 | Jing | G05B 19/182 |
| 2003/0186624 | A1 * | 10/2003 | Koike | G03F 1/60 451/8 |
| 2005/0048875 | A1 * | 3/2005 | Koo | B24B 49/14 451/7 |
| 2014/0370794 | A1 * | 12/2014 | Fukushima | B24B 37/32 451/387 |
| 2016/0214224 | A1 * | 7/2016 | Jing | G05B 19/182 |
| 2017/0014967 | A1 * | 1/2017 | Xie | B24B 49/14 |

FOREIGN PATENT DOCUMENTS

| | | | |
|---|---|---|---|
| JP | 09-70753 | A | 3/1997 |
| JP | 2004-106123 | A | 4/2004 |
| JP | 2004-306173 | A | 11/2004 |
| JP | 2005-342841 | A | 12/2005 |

* cited by examiner

WAFER POLISHING METHOD AND APPARATUS

TECHNICAL FIELD

The present invention relates to a wafer polishing method and apparatus and, more particularly, to a method of controlling polishing conditions in a single polishing process for a silicon wafer.

BACKGROUND ART

Silicon wafers are widely used as a substrate material for semiconductor devices. Silicon wafers are manufactured by sequentially applying processes such as outer periphery grinding, slicing, lapping, etching, double-side polishing, single-side polishing, cleaning, etc., to a silicon single crystal ingot. Among the above processes, the single-side polishing process is a process required in order to remove unevenness or waviness of the wafer surface and thus to enhance flatness, in which mirror finishing by CMP (Chemical Mechanical Polishing) method is performed.

Typically, in the single-side polishing process for a silicon wafer, a single wafer polishing apparatus (CMP apparatus) is used. The wafer polishing apparatus includes a rotating platen to which a polishing cloth is affixed and a pressurizing head that holds a wafer on the rotating platen while pressing the wafer. The apparatus polishes one side of the wafer by rotating the rotating platen and pressurizing head while feeding slurry.

For example, as a technique for improving wafer machining accuracy, Patent Document 1 describes a method including measuring the temperature of a polishing cloth affixed onto the upper surface of a polishing rotating platen during machining by using a radiation thermometer and controlling the temperature of the polishing rotating platen to a constant temperature by supplying cooling water to a water-cooled jacket or shutting off the supply so that the temperature of the polishing cloth is kept constant. Further, Patent Document 2 describes a semiconductor wafer mirror polishing apparatus in which a measurement head of an eddy current displacement sensor that measures the displacement of a rotating platen in a non-contact manner is provided from the radial center of the rotating platen to the outer peripheral portion thereof. A method using the measurement head of the eddy current displacement sensor is advantageous over a method that estimates a change in the shape of the rotating platen from a temperature change calculated by measuring the temperature on a polishing pad using a radiation thermometer or by measuring the temperature of collected polishing solution in that there occurs no delay in measurement results and that the shape change of the rotating platen can be measured accurately.

Further, Patent Document 3 describes a polishing method that polishes an object to be machined while rotating a table provided with a polishing cloth by a motor. In this method, a torque current value for the motor during polishing is obtained for each section in accordance with a polishing process, and a polishing time for the object to be machined is determined based on a multiple regression formula in which the torque current value for each section is set as an explanatory variable. Further, Patent Document 4 describes a polishing method that determines a polishing end point of an object to be machined, such as a silicon substrate, based on an integrated value of drive current for rotating a rotating platen for polishing the object to be machined so as to detect the polishing end point reliably and speedily.

CITATION LIST

Patent Document

[Patent Document 1] Japanese Patent Application Laid-Open No. H07-171759

[Patent Document 2] Japanese Patent Application Laid-Open No. H07-307317

[Patent Document 3] Japanese Patent Application Laid-Open No. 2004-106123

[Patent Document 4] Japanese Patent Application Laid-Open No. H09-70753

SUMMARY OF THE INVENTION

Problem to be Solved by the Invention

Conventionally, in a sheet polishing process, polishing is performed at a constant polishing pressure and at a constant rotating speed throughout polishing pad life from the start of use of a polishing pad to replacement thereof due to wear. However, physical properties of the polishing pad are changed along with the progress of the pad life, with the result that the shape of removal at the outer periphery of a wafer may differ between the beginning (start of usage of the polishing pad) and the end (immediately before replacement) of the polishing process even under the same machining conditions.

In order to produce more devices from one wafer, it is necessary to increase the acquisition number of chips in the vicinity of the edge region of the wafer as much as possible. Thus, it is demanded to narrow a region (region positioned in the vicinity of the edge of the wafer: edge exclusion region) not serving for the production of the device.

The outer periphery of the wafer is chamfered, so that it is desirable that only the chamfered region corresponds to the edge exclusion region. However, in a single-side polishing process, removal amount at the wafer outer peripheral portion is increased due to contact with the polishing pad, so that unintended reduction in thickness, i.e., outer peripheral sagging (edge roll-off) occurs in the vicinity of the wafer edge. Thus, it is very difficult to flatten the entire region of the inner side of the chamfered region with a required degree of flatness. Further, as described above, the sagging amount (edge roll-off amount) differs between the beginning and the end of the polishing pad life and, therefore, an appropriate approach to coping with the foregoing problem should be found.

Means for Solving the Problem

The object of the present invention is therefore to provide a wafer polishing method and apparatus capable of suppressing a variation in the shape of removal at the wafer outer periphery irrespective of the progress of the polishing pad life.

To solve the above problem, according to the present invention, there is provided a wafer polishing method of polishing one surface of a wafer by rotating a rotating platen to which a polishing pad is affixed and a pressurizing head while supplying slurry onto the rotating platen and pressurizing/holding the wafer on the polishing pad with the pressurizing head, the method including calculating an F/T value by monitoring a load current value F of a motor for rotating the rotating platen and a surface temperature T of the polishing pad during the wafer polishing and controlling at least one of the rotation speed of the rotating platen and the polishing pressure of the pressurizing head with respect to the wafer based on the calculated F/T value.

In the present invention, the load current value F and the surface temperature T represent the strength of mechanical polishing and that of chemical polishing, respectively, and the F/T value is an index representing a balance between a mechanical removing operation and a chemical removing operation. According to the wafer polishing method of the present invention, it is possible to grasp a slight change of a wafer edge roll-off amount with the progress of polishing pad life by monitoring the F/T value at all times. Then, by feeding back the F/T value to polishing conditions, it is possible to control the wafer edge roll-off amount to a constant value, thereby suppressing a variation in the shape of removal at the wafer outer periphery.

The wafer polishing method according to the present invention preferably increases the rotation speed of the rotating platen with an increase in the F/T value and also preferably reduces the polishing pressure of the pressurizing head with an increase in the F/T value. By thus controlling the rotation speed of the rotating platen or polishing pressure of the pressurizing head in accordance with an increase in the F/T value, it is possible to produce a wafer having a constant edge roll-off amount throughout the pad life.

The wafer polishing method according to the present invention preferably preferentially controls the rotation speed of the rotating platen over the polishing pressure of the pressurizing head. This is because the polishing pad may wear early when control to increase the polishing pressure of the pressuring head is performed, reducing the number of times of polishing process that one polishing pad can manage, which may degrade productivity. Such a problem can be solved by increasing the control amount of the rotating platen as much as possible.

The wafer polishing method according to the present invention preferably sets the rotation speed of the rotating platen or the polishing pressure of the pressurizing head in a wafer machining process of subsequent batches based on the F/T value measured in a wafer machining process of the previous batch. Thus, it is possible to prevent adverse influence on wafer quality that may be caused due to a change in polishing conditions during the polishing process, and, also, there is no problem of control delay.

Further, according to the present invention, there is provided a wafer polishing apparatus that polishes one surface of a wafer by rotating a rotating platen to which a polishing pad is affixed and a pressurizing head while supplying slurry onto the rotating platen and pressurizing/holding the wafer on the polishing pad with the pressurizing head, the apparatus including a current measurement circuit for measuring a load current value F of a motor for rotating the rotating platen, a thermometer for measuring a surface temperature T of the polishing pad, and a controller that calculates an F/T value from the load current value F and the surface temperature T and controls at least one of the rotation speed of the rotating platen and the polishing pressure of the pressurizing head based on the calculated F/T value.

According to the present invention, it is possible to suppress a variation in the shape of removal at the wafer outer periphery throughout polishing pad life, thereby producing a wafer having a constant edge roll-off amount.

In the present invention, the controller preferably increases the rotation speed of the rotating platen in accordance with an increase in the F/T value and preferably reduces the polishing pressure of the pressurizing head in accordance with an increase in the F/T value. By thus controlling the rotation speed of the rotating platen or the polishing pressure of the pressurizing head in accordance with an increase in the F/T value, it is possible to produce a wafer having a constant edge roll-off amount throughout the pad life.

In the present invention, the controller preferably preferentially controls the rotation speed of the rotating platen over the polishing pressure of the pressurizing head. This is because the polishing pad may wear early when control to increase the polishing pressure of the pressuring head is performed, reducing the number of times of polishing process that one polishing pad can manage, which may degrade productivity. Such a problem can be solved by increasing the control amount of the rotating platen as much as possible.

In the present invention, the controller preferably sets the rotation speed of the rotating platen or the polishing pressure of the pressurizing head in a wafer machining process of subsequent batches based on the F/T value measured in a wafer machining process of the previous batch. Thus, it is possible to prevent adverse influence on wafer quality that may be caused due to a change in polishing conditions during the polishing process, and, also, there is no problem of control delay.

Advantages of the Invention

According to the present invention, there can be provided a wafer polishing method and apparatus capable of suppressing a variation in the shape of removal at the wafer outer periphery irrespective of the progress of the polishing pad life.

BRIEF DESCRIPTION OF DRAWINGS

A preferred embodiment of the present invention will be described in detail below with reference to the accompanying drawings.

Figure 1:
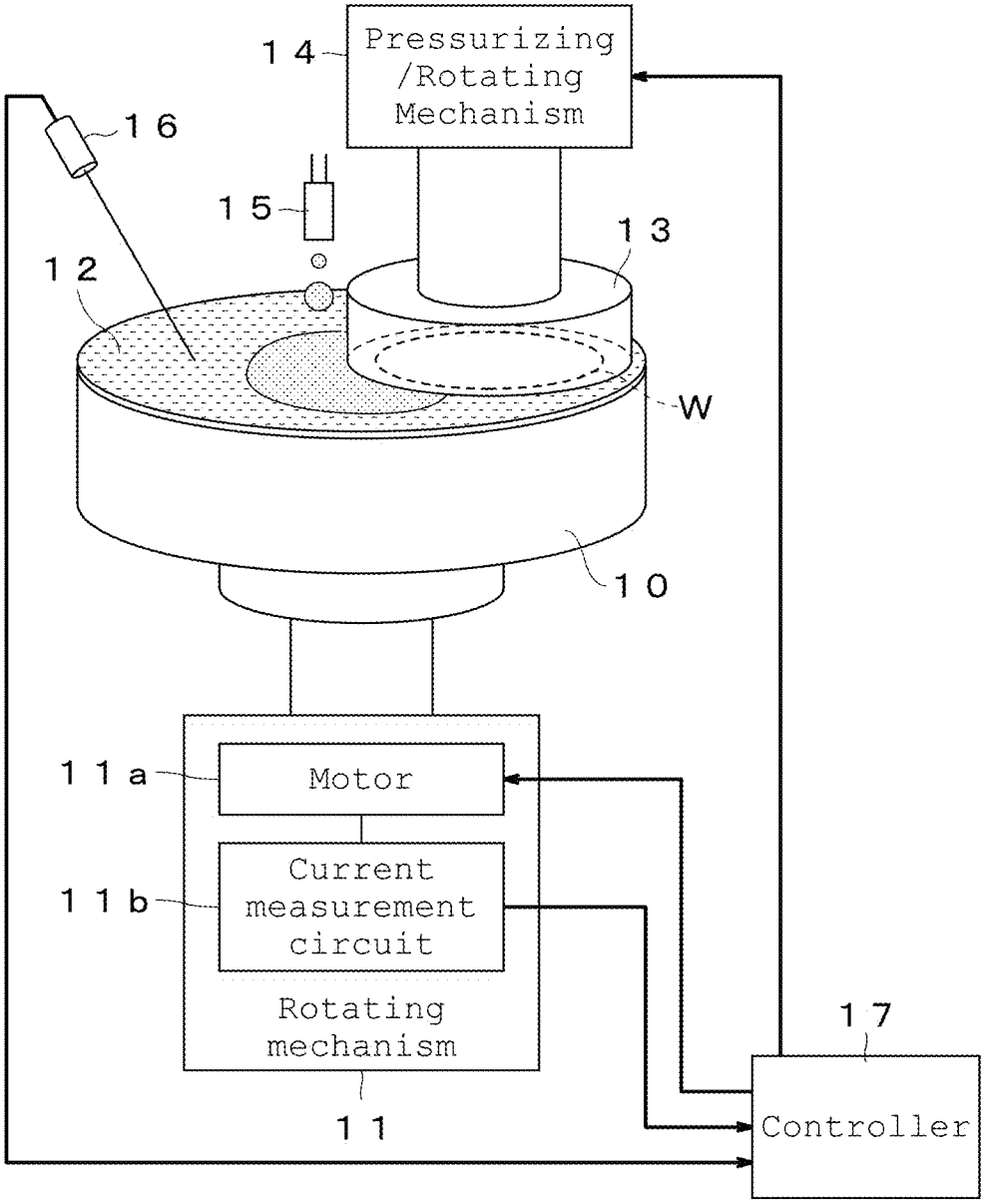
FIG. 1 is a schematic side view illustrating the configuration of a wafer polishing apparatus according to an embodiment of the present invention.

FIG. 1 is a schematic side view illustrating the configuration of a wafer polishing apparatus according to an embodiment of the present invention.

As illustrated in FIG. 1, a wafer polishing apparatus 1 has a rotating platen 10, a rotating mechanism 11 for the rotating platen 10, a suede type polishing pad 12 affixed onto the upper surface of the rotating platen 10, a pressurizing head 13 disposed above the rotating platen 10, a pressurizing/rotating mechanism 14 for the pressurizing head 13, and a slurry supply mechanism 15 for supplying slurry onto the rotating platen 10. The wafer polishing apparatus 1 further has a radiation thermometer 16 for measuring a surface temperature T of the polishing pad 12 during wafer polishing in a non-contact manner, a current measurement circuit 11*b* for measuring a load current value F of a motor 11*a* provided in the rotating mechanism 11 for rotating the rotating platen 1U, and a controller 17 for controlling the above components.

In a wafer polishing process using the wafer polishing apparatus 1, the rotating platen 10 is rotated with slurry containing abrasive grains supplied onto the rotating platen 10 to which the polishing pad 12 is affixed and with a wafer on the rotating platen 10 pressurized/held by the pressurizing head 13 to polish one surface of the wafer that contacts the polishing pad 12. This single-side polishing is a finishing process for the wafer that has been subjected to double-side polishing of the previous stage, so that a wafer polishing amount (removal amount) is several hundred nm to 1 μm, and a processing time is as extremely short as about several minutes. This is because when the polishing time is too long, the edge roll-off amount of the wafer is increased to degrade the shape of removal at the outer periphery.

The edge roll-off amount (ROA) refers to a sagging amount on a wafer surface at the boundary between an edge exclusion region that is out of the application range of flatness standards and a region inside the edge exclusion region. Specifically, the inclination of a wafer surface is corrected in a state where the back surface of the wafer is properly flattened, and a flat region of the wafer surface at 3 mm to 6 mm position from the outermost periphery thereof is set to a reference plane. In this state, the edge roll-off amount is defined as a shape displacement amount from the reference plane at e.g., 0.5 mm position from the outermost periphery.

During the wafer polishing, the controller 17 captures the surface temperature T of the polishing pad 12 measured by the radiation thermometer 16 and captures the load current value F of the motor 11*a* for rotating the rotating platen 10 from the current measurement circuit 11*b* and then calculates a F/T value while monitoring the values T and F at all times.

The load current value F of the motor 11*a* is defined as an index representing the magnitude of friction, that is, the strength of a mechanical removing operation, and the larger the load current value F is, the larger the F/T value becomes. An increase in the load current value F under a condition that the rotation speed of the rotating platen 10 is constant refers an increase in frictional force with respect to the rotating platen 10. Due to an increase in a mechanical polishing amount by abrasive grains, the wafer edge roll-off amount is reduced, but the polishing amount of the entire wafer surface tends to be increased.

The surface temperature T of the polishing pad 12 is defied as an index representing the strength of a chemical removing operation, and the higher the surface temperature T is, the smaller the F/T value becomes. An increase in the surface temperature T refers to promotion of chemical reaction of the slurry. Due to an increase in chemical polishing amount by the slurry, the wafer edge roll-off amount is increased, but the polishing amount of the entire wafer surface tends to be reduced.

Figure 2:
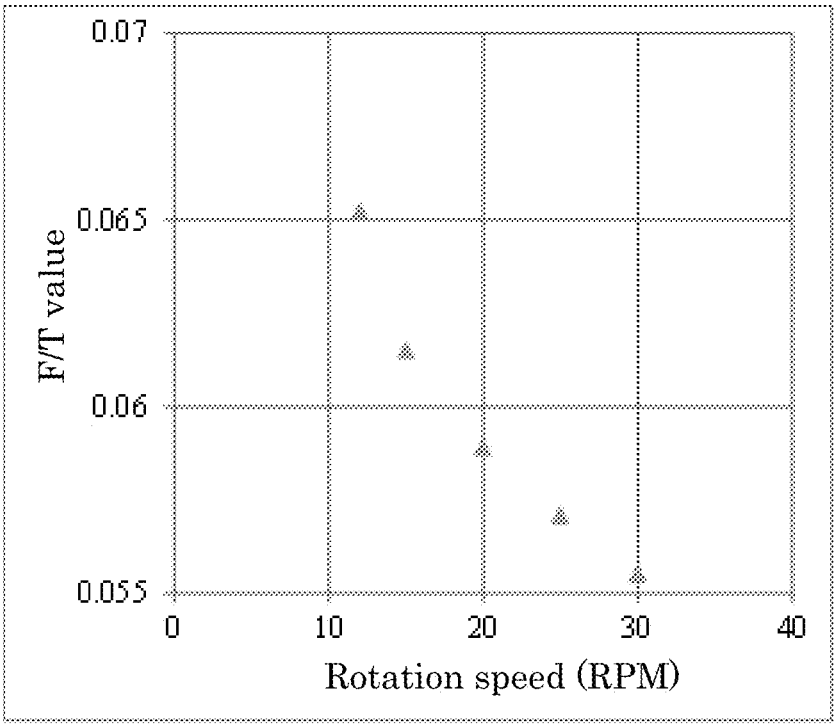
FIG. 2 is a graph illustrating the relationship between the rotation speed of the rotating platen and F/T value.
Figure 3:
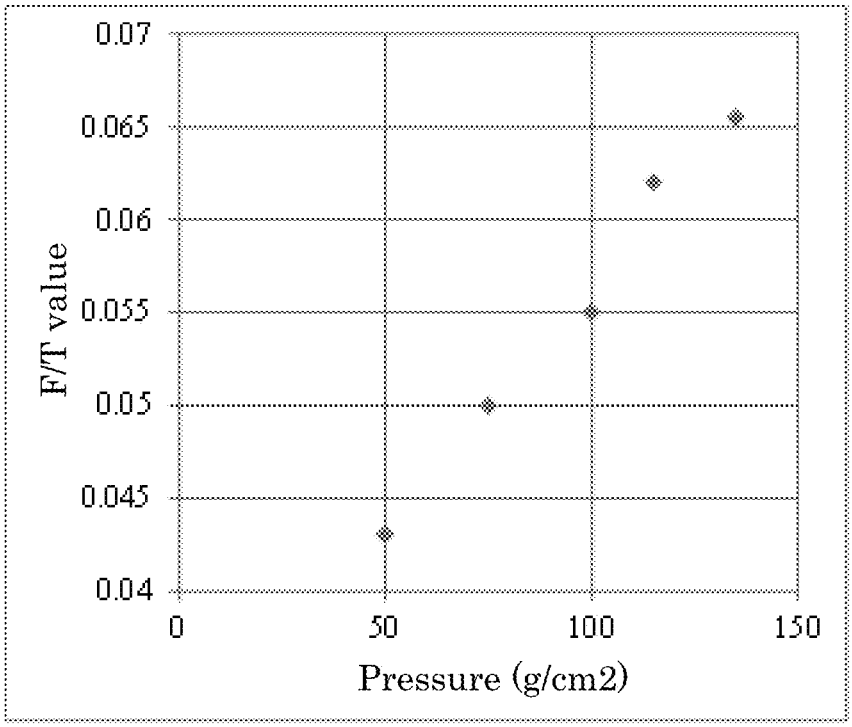
FIG. 3 is a graph illustrating the relationship between the polishing pressure of the pressurizing head and F/T value.

FIG. 2 is a graph illustrating the relationship between the rotation speed of the rotating platen 10 and F/T value, and FIG. 3 is a graph illustrating the relationship between the polishing pressure of the pressurizing head 13 and F/T value.

As illustrated in FIG. 2, the F/T value tends to be reduced as the rotation speed of the rotating platen 10 is increased. Thus, the F/T value can be reduced by increasing the rotation speed of the rotating platen 10, and the F/T value can be increased by reducing the rotation speed of the rotating platen 10.

As illustrated in FIG. 3, the F/T value tends to be increased as the polishing pressure of the pressurizing head 13 is increased. Thus, the F/T value can be reduced by reducing the polishing pressure of the pressurizing head 13, and the F/T value can be increased by increasing the polishing pressure of the pressurizing head 13.

Figure 4:
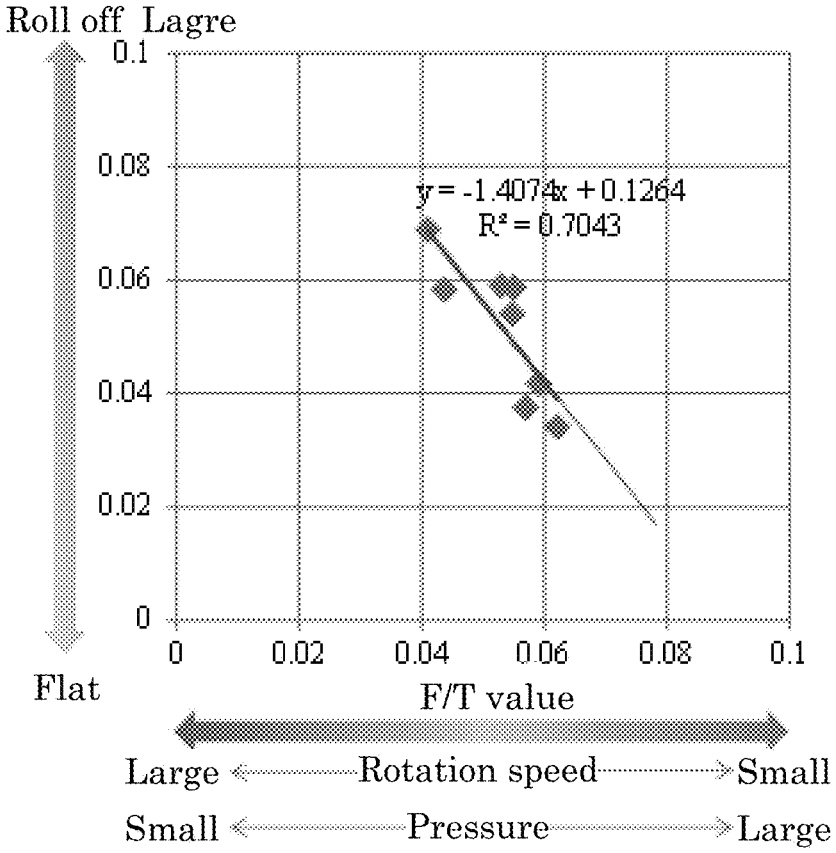
FIG. 4 is a graph illustrating the relationship between the F/T value and the wafer edge roll-off amount.

FIG. 4 is a graph illustrating the relationship between the F/T value and the wafer edge roll-off amount, in which the horizontal axis indicates the F/T value, and the vertical axis indicates the roll-off amount (relative value).

As illustrated in FIG. 4, the wafer edge roll-off amount tends to be reduced as the F/T value is increased and tends to be increased as the F/T value is reduced. Thus, the wafer edge roll-off amount can be reduced by increasing the F/T value, and the wafer edge roll-off amount can be increased by reducing the F/T value.

As illustrated in FIGS. 2 and 3, the F/T value can be increased by reducing the rotation speed or increasing the polishing pressure, so that the wafer edge roll-off amount can be reduced by such control. Further, the F/T value can be reduced by increasing the rotation speed or reducing the polishing pressure, so that the wafer edge roll-off amount can be increased by such control.

The wafer edge roll-off amount is large at the beginning of pad life of the polishing pad 12 and is gradually reduced with the progress of the pad life. The F/T value is gradually increased with the progress of the pad life as the wafer edge roll-off amount is reduced. In the present embodiment, in order to suppress such increase in the F/T value at the beginning of the pad life, the rotation speed of the rotating platen 10 is increased, or the polishing pressure of the pressurizing head 13 is reduced. Then, the rotation speed is gradually reduced with the progress of the pad life, or polishing pressure is gradually increased with the progress of the pad life. This allows the F/T value to be kept constant, thus making it possible to suppress fluctuation in the wafer edge roll-off amount, that is, variation in the shape of removal at the wafer outer periphery.

As described above, the wafer edge roll-off amount may be controlled by the rotation speed of the rotating platen 10 or the polishing pressure of the pressurizing head 13, although it is more preferable to control the wafer edge roll-off amount by the rotation speed of the rotating platen 10. This is because when the above control is performed by the polishing pressure of the pressurizing head 13, the polishing pad 12 wears off faster (replacement time of the polishing pad as comes early), so that the number of wafers that one polishing pad 12 can polish is reduced to lower productivity. When the rotation speed of the rotating platen 10 is preferentially controlled, it is preferable to select a rotation speed of the rotating platen 10 closest to a target F/T value and then to control the polishing pressure so as to correct an error from the target value. By doing this, it is possible to enhance accuracy in controlling the wafer edge roll-off amount while suppressing wear of the polishing pad 12.

There is no need to change the rotation speed of the rotating platen 10 or the polishing pressure of the pressurizing head 13 in real time during the wafer machining process, but the rotation speed or polishing pressure in the wafer polishing process of the subsequent batch or batches may be set based on the F/T value measured in the wafer polishing process of the previous batch. This is because when the condition is changed during machining, wafer quality may be adversely affected, and because a problem of control delay hardly occurs even when the condition set in the previous batch is changed in the subsequent batch.

The wafer polishing apparatus 1 applies polishing, in a batch, to wafers as many as the maximum number of wafers to be accommodated in a wafer case. For example, when 25 wafers can be accommodated in one wafer case, the wafer polishing apparatus 1 successively applies polishing to the first 25 wafers under the same polishing conditions. Then, after completion of the polishing for the first 25 wafers, the wafer polishing apparatus 1 applies polishing to the second 25 wafers. At the start of the polishing for the second 25 wafers, new polishing conditions can be set. The number of wafers to be polished in a batch under the same polishing conditions is preferably 10 to 30, but may be one. That is, the polishing conditions may be reset every time polishing for one wafer is completed. As described above, by setting polishing conditions following a change in the F/T value in a shortest period so that wafer quality is not adversely affected, the wafer edge roll-off amount can be kept constant throughout the pad life.

As described above, in the wafer polishing method according to the present embodiment, the load current value F of the motor 11*a* for rotating the rotating platen 10 is defined as an index representing the strength of mechanical polishing, and the surface temperature T of the polishing pad 12 measured by the radiation thermometer 16 is defined as an index representing the strength of chemical polishing. By monitoring both values F and T at all times, the F/T value is fed back to the control of the rotation seed of the rotating platen 10 or the control of the polishing pressure of the pressurizing head 13. Thus, even when the physical property value of the polishing pad 12 is changed with the progress of polishing pad life, it is possible to suppress variation in the shape of removal at the wafer outer periphery, thus allowing a wafer having a constant edge roll-off amount to be produced. Further, the method according to the present embodiment is advantageous over passive control of changing the rotation speed of the rotating platen 10 in accordance with the progress of the pad life at a fixed change rate in that an individual difference in the physical value of the polishing pad 12 or fluctuation in the physical value due to the progress of the pad life can be grasped more accurately for subsequent control.

While the preferred embodiment of the present invention has been described, the present invention is not limited to the above embodiment but may be variously modified without departing from the spirit of the present invention. Accordingly, all such modifications are included in the present invention.

Example

Silicon wafer samples with a thickness of 776 μm were obtained by applying outer periphery grinding, slicing, lapping, etching, and double-side polishing to a silicon single crystal ingot with a diameter of 300 mm grown by the Czochralski method. Then, the wafer polishing apparatus illustrated in FIG. 1 was used to apply single-side polishing to the silicon wafer samples. In the single-side polishing, a target removal amount of the wafers was set to 1 μm. As the polishing pad 12, a suede type polishing pad was used. As slurry, slurry containing 0.3 wt % colloidal silica having a particle diameter of 35 nm was used.

Thereafter, a change in ESFQR (Edge Site Front least sQuares Range) of a large number of silicon wafers that had been polished throughout the pad life from its beginning to its end (replacement) was evaluated. The ESFQR is an evaluation index for flatness (site flatness) focusing on the edge portion where flatness is easily degraded and indicates the magnitude of the edge roll-off amount. The ESFQR targets a unit region (site) obtained by evenly dividing a ring-shaped region along the wafer edge in the peripheral direction and is defined as a difference between maximum and minimum values of deviation from a reference surface (Site best Fit Surface) calculated from a thickness distribution in the site by least square method. In this example, ESFQRs of 72 sites obtained by dividing a ring-shaped outer peripheral region set in 2 mm to 32 mm range (sector length: 30 mm) from the wafer outermost periphery were measured, and then a mean value ESFQR_mean of all the sites was calculated.

As a comparative example, a large number of wafers were polished with the polishing pressure of the pressurizing head 13 fixed to 150 g/cm and the rotation speed of the rotating platen 10 fixed to 30 rpm, respectively, and then the ESFQR_mean values of the resultant wafers were calculated.

Figure 5:
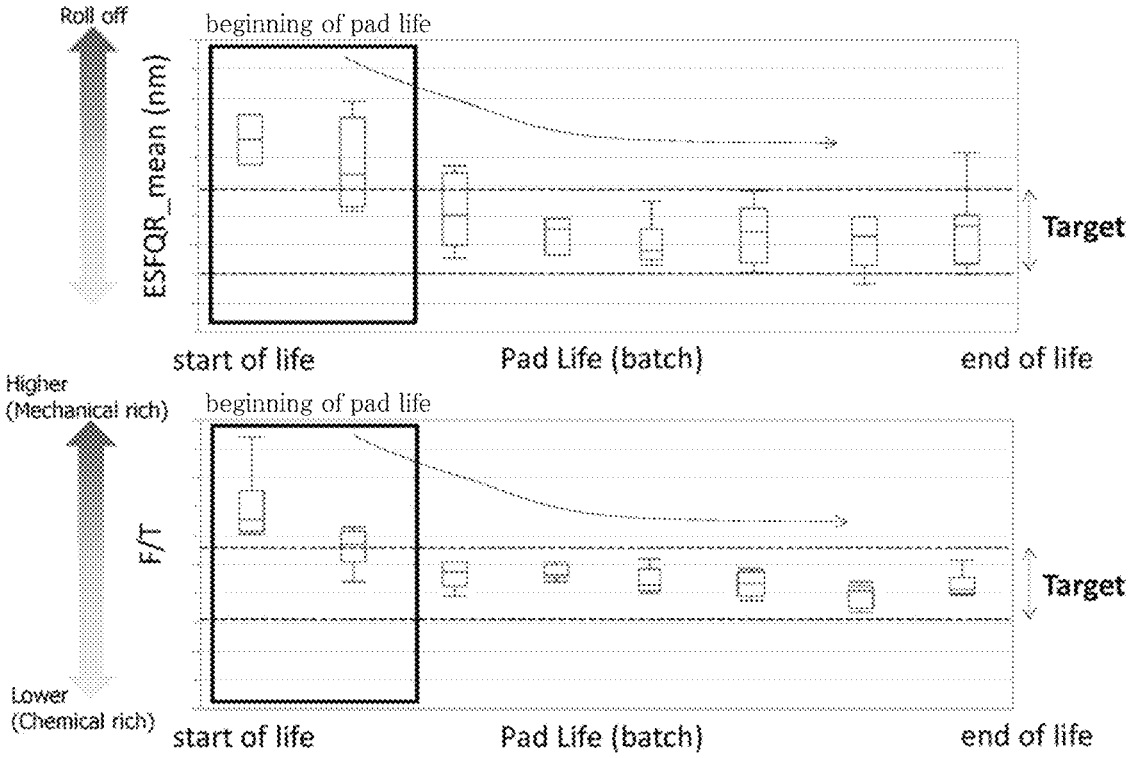
FIG. 5 is a graph illustrating changes in the respective ESFQR and F/T values of the wafer with the progress of polishing pad life according to the comparative example of the conventional wafer polishing method.

FIG. 5 is a graph illustrating changes in the respective ESFQR and F/T values of the wafer with the progress of polishing pad life, in which the horizontal axis indicates the number of times of batch processing, the vertical axis indicates the ESFQR_mean (nm), and the box-and-whisker diagram indicates a variation in the ESFQR_mean values of the 25 wafers polished in the same batch. As illustrated in FIG. 5, in the beginning of pad life, the F/T values were larger than the target range, and the ESFQR_mean value was larger than the target value. Further, a variation in the ESFQR_mean values was very large.

Figure 6:
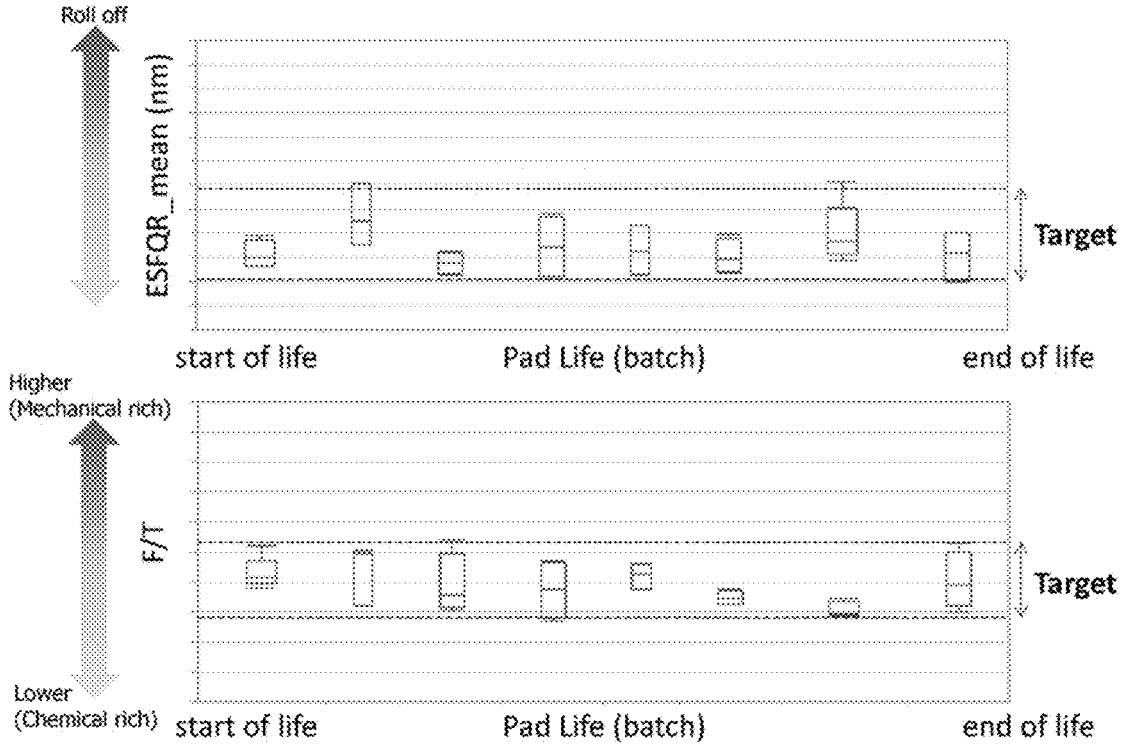
FIG. 6 is a graph illustrating changes in the respective ESFQR and F/T values of the wafer with the progress of polishing pad life according to the first example of the wafer polishing method.

On the other hand, in Example 1, a large number of wafers were polished with the polishing pressure of the pressurizing head 13 fixed to 150 g/cm$^2$ and with the rotation speed of the rotating platen 10 controlled within a range of 20 rpm to 60 rpm so that the F/T values fall within the target range, and the ESFQR mean values of the resultant wafers were calculated. As a result, as illustrated in FIG. 6, throughout the pad life, the ESFQR mean values successfully fell within the target range, and the F/T values were stable.

Figure 7:
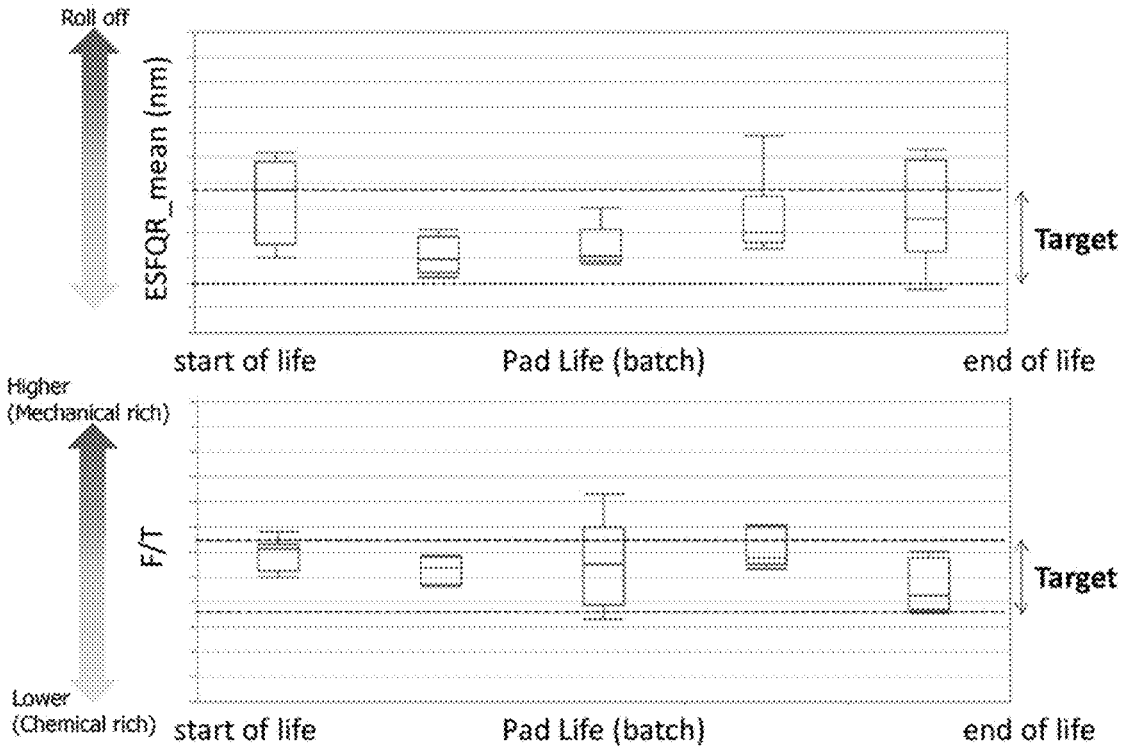
FIG. 7 is a graph illustrating changes in the respective ESFQR and F/T values of the wafer with the progress of polishing pad life according to the second example of the wafer polishing method.

Further, as Example 2, a large number of wafers were polished with the rotation speed of the rotating platen 10 fixed to 30 rpm and with the polishing pressure of the pressurizing head 13 controlled within a range of 100 g/cm$^2$ to 200 g/cm$^2$ so that the F/T values fall within the target range, and the ESFQR_mean values of the resultant wafers were calculated. As a result, as illustrated in FIG. 7, throughout the pad life, the ESFQR_mean values successfully fell within the target range, and the F/T values were stable. However, the lifetime of the polishing pad 12 was shortened to reduce the number of wafers that can be polished by one wafer, resulting in degradation of productivity.

1 wafer polishing apparatus
10 rotating platen
11 rotating mechanism of the rotating platen

11*a* motor
11*b* current measurement circuit
12 polishing pad
13 pressurizing head
14 pressurizing/rotating mechanism
15 slurry supply mechanism
16 radiation thermometer
17 controller
F load current value of the motor
T surface temperature of the polishing pad

What is claimed is:

1. A wafer polishing method of polishing one surface of a wafer by rotating a rotating platen to which a polishing pad is affixed and a pressurizing head while supplying slurry onto the rotating platen and pressurizing/holding the wafer on the polishing pad with the pressurizing head, the method comprising:

calculating an F/T value by monitoring a load current value F of a motor for rotating the rotating platen and a surface temperature T of the polishing pad during the wafer polishing; and controlling at least one of the rotation speed of the rotating platen and the polishing pressure of the pressurizing head based on the calculated F/T value.

2. The wafer polishing method as claimed in claim 1, wherein the rotation speed of the rotating platen is increased in accordance with an increase in the F/T value.

3. The wafer polishing method as claimed in claim 1, wherein the polishing pressure of the pressurizing head is reduced in accordance with an increase in the F/T value.

4. The wafer polishing method as claimed in claim 1, wherein the rotation speed of the rotating platen is preferentially controlled over the polishing pressure of the pressurizing head.

5. The wafer polishing method as claimed in claim 1, wherein the rotation speed of the rotating platen or the polishing pressure of the pressurizing head in a wafer machining process of subsequent batches is set based on the F/T value measured in a wafer machining process of the previous batch.

6. A wafer polishing apparatus that polishes one surface of a wafer by rotating a rotating platen to which a polishing pad is affixed and a pressurizing head while supplying slurry onto the rotating platen and pressurizing/holding the wafer on the polishing pad with the pressurizing head, the apparatus comprising:

a current measurement circuit for measuring a load current value F of a motor for rotating the rotating platen;

a thermometer for measuring a surface temperature T of the polishing pad; and a controller that calculates an F/T value from the load current value F and the surface temperature T and controls at least one of the rotation speed of the rotating platen and the polishing pressure of the pressurizing head based on the calculated F/T value.

7. The wafer polishing apparatus as claimed in claim 6, wherein the controller increases the rotation speed of the rotating platen in accordance with an increase in the F/T value.

8. The wafer polishing apparatus as claimed in claim 6, wherein the controller reduces the polishing pressure of the pressurizing head in accordance with an increase in the F/T value.

9. The wafer polishing apparatus as claimed in claim 6, wherein the controller preferentially controls the rotation speed of the rotating platen over the polishing pressure of the pressurizing head.

10. The wafer polishing apparatus as claimed in claim 6, wherein the controller sets the rotation speed of the rotating platen or the polishing pressure of the pressurizing head in a wafer machining process of subsequent batches based on the F/T value measured in a wafer machining process of the previous batch.

* * * * *